US008566983B2

(12) United States Patent
Monaco

(10) Patent No.: US 8,566,983 B2
(45) Date of Patent: Oct. 29, 2013

(54) BED COVERING

(76) Inventor: Natalie Brooke Monaco, Blacklick, OH (US)

( * ) Notice: Subject to any disclaimer, the term of this patent is extended or adjusted under 35 U.S.C. 154(b) by 112 days.

(21) Appl. No.: 12/762,193

(22) Filed: Apr. 16, 2010

(65) Prior Publication Data

US 2010/0269259 A1 Oct. 28, 2010

Related U.S. Application Data

(60) Provisional application No. 61/172,054, filed on Apr. 23, 2009.

(51) Int. Cl.
*A47G 9/02* (2006.01)

(52) U.S. Cl.
USPC ..... 5/498; 5/494

(58) Field of Classification Search
USPC ..... 5/486, 494, 496–500, 502, 482, 495, 5/655; 24/72.5; D6/602, 603, 607
See application file for complete search history.

(56) References Cited

U.S. PATENT DOCUMENTS 557,456 A 3/1896 Utter
1,950,084 A 3/1934 Halsey
2,024,050 A * 12/1935 May ..... 24/72.5
2,223,412 A 12/1940 Gartz
2,284,778 A 6/1942 Treiber
2,450,923 A 10/1948 Spiro
3,144,666 A 8/1964 Ragsdale
3,987,505 A 10/1976 Hickey
4,045,831 A 9/1977 Clark
4,199,830 A 4/1980 Ogata
4,389,744 A * 6/1983 Monroe ..... 5/498
4,627,363 A 12/1986 Jones
4,698,880 A 10/1987 Hamm
5,027,460 A * 7/1991 Honig ..... 5/497
5,377,391 A 1/1995 Foster
5,542,137 A * 8/1996 Byfield ..... 5/500
5,732,424 A 3/1998 Bond
5,815,861 A 10/1998 LaGrange et al.
5,996,147 A * 12/1999 Trimble ..... 5/482
6,014,782 A * 1/2000 Stevenson ..... 5/499
6,233,764 B1 5/2001 Orr
6,286,163 B1 9/2001 Trimble
6,708,356 B1 3/2004 LaValle
7,152,260 B2 * 12/2006 Ota ..... 5/504.1
7,370,377 B2 5/2008 Landry

* cited by examiner

*Primary Examiner* — Nicholas Polito

(57) ABSTRACT

An improved bed covering comprising a generally rectangular cover piece and an elastic member attached to the bottom side of the cover piece near the bottom of the bed. The member comprising an adjusting means and having sufficient length to extend under a mattress such that the member is not visible while the covering is positioned on the bed.

8 Claims, 4 Drawing Sheets

BED COVERING

CROSS-REFERENCES TO RELATED APPLICATIONS

The present application claims priority to Provisional Application No. 61/172,054 filed Apr. 23, 2009, which is hereby incorporated by reference in its entirety.

FIELD OF THE INVENTION

This invention relates to bed coverings typically used in households. More particularly, it relates to an improved bed covering or comforter that keeps both the bed covering itself and any sheets and/or covers beneath the bed covering tucked underneath a mattress and in place. Unlike any other bed covering, it is designed with an integral attachment member that gives it the unique ability to stay in place on the bed, and therefore it facilitates bed-making and also keeps the bed occupant comfortable and covered.

BACKGROUND OF THE INVENTION

As customary in our culture, beds are usually made with a fitted sheet and a top sheet tucked under the mattress, and a comforter loosely placed on top of the top sheet. With a loose bed covering, or even one that is tucked under the mattress along with the top sheet, the bed covering may be pulled free from the bed. A restless sleeper can accidentally kick the cover out of its desired position, thus causing the bed to have to be completely re-made after each use. This is frustrating for the person making the bed, because it takes extra time and effort to tuck the sheet in under the mattress again, reposition the bed covering, and re-make the bed. During sleep, not only are bed coverings typically mangled, but the sheets and covers beneath them can also be kicked out of place. This is frustrating for the bed occupant, because throughout the night the bed occupant can often become uncovered, cold and uncomfortable.

There have been numerous attempts to solve the problems associated with bed-making and disorderly bedding. These devices and methods have not solved the problem, either because they are too cumbersome or complicated, or because they lack effectiveness. Specifically, most related art disclose devices or appliances, not an actual bed covering, that the user must attach to any given bed covering after they have purchased the bed covering. The problem with such an attachment is that the user risks damaging their bed covering by attaching the required connecting means. This is undesirable because most people would not want to alter, puncture, or damage a bed covering that they have already purchased by applying some kind of clamp, device or attachment.

A more effective way to secure the bed covering in position is needed, as is an easy and simple method for securing the bed covering to the mattress. Attempts have been made to solve the problem. U.S. Pat. No. 2,223,412 to Gartz uses two plate-like anchors attached to narrow straps on each side. The anchors and straps are placed underneath a mattress, and the straps are then connected to a bed covering with a connecting means that the user must attach to a bed covering. U.S. Pat. No. 7,467,428 to Hanes is a device that uses an elongated clamping member to secure a bed cover upon a bed. U.S. Pat. No. 6,122,783 to Herdon is constructed of a mattress band that is removably securable to a mattress along at least two opposite sides of a mattress. Removably securable to the mattress band is a top cover that connects to the mattress band with securing connections. U.S. Pat. No. 2,024,050 to May uses a device with a narrow strap. The strap is attached to a bed covering with a connecting means that the user must attach to a bed covering. U.S. Pat. No. 6,286,163 to Trimble is a bed sheet construction including a main panel having mattress encompassing pouches at opposite ends that fittingly engages a mattress.

While the above mentioned patents contemplate various systems for retaining bedding, these systems are distinguishable in both form and function from the present invention. The structural arrangements of the above mentioned art differ in material respects to the present invention and do not address the problem sufficiently. In addition to risk of damaging the user's bed covering, prior related art does not solve the problem of the attached strap slipping off of the corner of the foot of the mattress. These differences are essential for the functional use of the present invention and will be described in more detail herein.

SUMMARY OF THE INVENTION

The present invention solves the problems associated with prior art. It is a bed covering, with an integral securing means, not an appliance or separate device, that covers a mattress and/or sheets while attaching the bed covering securely to the foot end of the mattress. The object of the bed covering is to facilitate bed-making and maximize comfort by keeping the bed covering in place under the foot end of the mattress. An additional objective of the improved bed covering is to keep any sheets and/or blankets beneath it in place under the foot end of the mattress. The bed covering comprises a stretchable, flexible member attached to the under-side of a covering piece, near the bottom corners of the covering piece. When positioned on a bed, the flexible member is located near the foot end of the mattress.

In an embodiment, the improved bed covering comprises a generally rectangular cover piece comprising a first end and a second end. The second end is opposite the first end. The cover piece has a first side and a second side. The second side of the cover piece is opposite the first side. The cover piece has a top side and a bottom side. The top side of the cover piece is opposite the bottom side and connected to the bottom side at the first and second end and the first and second side. In an embodiment, the cover piece is one of a comforter, a blanket, a quilt and a duvet cover.

The improved bed covering also comprises a relatively thin elastic member having a width sufficient to properly hold the top piece in place and a length sufficient to allow the member to extend under a mattress when the invention is placed on a bed. The member is comprised of a stretchable, flexible, preferably washable material. In an embodiment, the member is a fabric having a laid-in structure of at least longitudinally extending elastene strands or filaments. In an embodiment, the member is layered with a rubber or elastene central layer covered with a flexible fabric covering. The member has a mattress side and a side opposite the mattress side.

The member is wider than existing straps disclosed in prior art. The member is about 2-15 inches, preferably about 6-10 inches wide. In an embodiment, the member is 6 inches wide. The width of the member elongates the area where pulling force exists, thus keeping the bed covering in place more effectively than a narrow strap.

The invention can be used on mattresses of any typical rectangular size, including but not limited to twin, single, queen, king, California king and the like, having any depth, including standard, pillow-top and extra deep, and the like, as well as any construction, including fabric, feathers, springs, air, foam or water filled and the like. In an embodiment, the improved bed covering of the present invention is used with a mattress alone. In an embodiment, the present invention is used with a mattress on top of another surface, such as but not limited to a box spring, a floor, a mattress support, a bed frame and the like. In an embodiment, the cover piece is placed over other bedding, such as but not limited to pads, sheets, blankets, other comforters and the like.

The member is attached to the bottom side of the cover piece at a first position at a point proximate to the first side by a first edge of the member and the second end and at a second position proximate to the second side and the second end piece by a second edge of the member such that the member extends under the mattress but is not visible while the cover is positioned on the bed.

In an embodiment, the member is permanently attached to the cover piece. In an embodiment, the member is attached to the cover piece by at least one of stitching, hot bonding, gluing and the like. In an embodiment, the member is detachable. The detachable embodiment has separate pieces: i) a strap that is removably attachable to the left side of the bed covering, ii) a strap that is removably attachable from the right side of the bed covering and then attached to the left strap at or near the adjustment means, and iii) the bed covering itself. Although the alternative detachable means is an option, the permanent method of attachment is preferred. Fewer components make for a simpler product. The method of permanent attachment is also preferred because, with the detachable means there is the possibility of the member coming unsnapped, unhooked or ripping the detachable connecting means from the bed covering.

In an embodiment, the member comprises a gripping surface that maintains the member in place under the mattress. In an embodiment, the gripping surface is a feature of the material from which the member is made. In an alternate embodiment, the gripping surface is a feature added to the member, such as a rubbery polymer foam layer applied to the member or a layer of the member with heat bonding, glue, sewing and the like. In an embodiment, the gripping surface is a discontinuous surface applied to only part of the surface of the member. In an embodiment, the gripping surface is a continuous sheet. When a discontinuous surface is employed, at least about 10-50% of the total surface area of one surface of the member. In an embodiment, the gripping surface protrudes from the member in the form of bumps or ridges and in any pattern including geometric forms and pattern as well as text designs and the like. In an embodiment, the gripping surface is applied to or is integral to at least one of the mattress side and the side opposite the mattress side of the member.

In an embodiment, the gripping surface has a rubber-like texture, such as that used to keep rugs in place on a floor, or the anti-slip lining material used to line drawers and cupboards. In an embodiment, the gripping surface extends along the entire length of the member, and on both sides of the member. The width of the member combined with a no-slip texture keeps it from sliding around the mattress corner, or out of its desired position. When it is time to make the bed after a restless night of sleep, the bed covering is on top of the mattress, with each foot end corner in place. The bed covering's member attaches underneath the bed covering and remains out-of-sight, and the bed maker can make the bed with much less work, effort, and in less time.

Mattresses are sold in all different thicknesses, and recently pillow top mattresses have become popular. An advantage of the improved bed covering is that the member may be adjusted to accommodate mattresses of different thicknesses, or adjusted to the desired tightness or comfort level of the bed occupant. In an embodiment, the member comprises an adjusting means that enables a user to adjust the length of the member. In an embodiment, the adjusting means is at least one of a button, a buckle, a sliding buckle, a lace-up, a snap-lock fastener, sets of snaps or hooks in rows, a hook and loop fastener and the like. In an embodiment, the adjusting means is positioned on the member at a position that is not under the mattress so that the user can adjust the member when the bed covering is in place.

The improved bed covering of the present invention is attached to a bed by placing the cover piece on top of the mattress, and positioning the member underneath the mattress proximate a foot end of the bed.

An advantage of the present invention is that it is simpler to put into place than devices disclosed in prior art. In order for a method to be desirable to a user, it must be simple and easy to apply. In many instances, prior art bed cover attaching means involve cumbersome and complicated hardware, anchors, fasteners, clamps, and clips. The present invention is simply put into place by: i.) placing the covering piece on top of the bed and on top of any sheets/blankets beneath it, ii.) stretching the flexible elastic member around one corner of the foot end of the mattress, (similar to the method used to place a fitted sheet around and underneath the mattress corner) and, iii.) repeating the motion described in (ii) on the remaining opposite mattress corner.

Once in place, the elastic composition of the member allows the bed occupant to move and turn comfortably underneath the covering piece. The covering piece is held in a position proximate to the mattress, thus reducing the tendency for an occupant to completely or partially remove the covering piece from another bed occupant, or become uncovered themselves. The person making the bed no longer has to completely re-organize a heap of mangled bed covers and re-make the bed, because the present invention provides a bed covering and bedding that is secured in place during sleep.

As used herein, "approximately" means within plus or minus 25% of the term it qualifies. The term "about" means between ½ and 2 times the term it qualifies.

The compositions and methods of the present invention can comprise, consist of, or consist essentially of the essential elements and limitations of the invention described herein, as well as any additional or optional ingredients, components, or limitations described herein or otherwise useful in compositions and methods of the general type as described herein.

Numerical ranges as used herein are intended to include every number and subset of numbers contained within that range, whether specifically disclosed or not. Further, these numerical ranges should be construed as providing support for a claim directed to any number or subset of numbers in that range or to be limited to the exact conversion to a different measuring system, such, but not limited to, as between inches and millimeters.

All references to singular characteristics or limitations of the present invention shall include the corresponding plural characteristic or limitation, and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

Terms such as "top," "bottom," "right," "left," "above", "under", "side" and the like are words of convenience and are not to be construed as limiting.

DETAILED DESCRIPTION OF THE DRAWINGS

Figure 1:
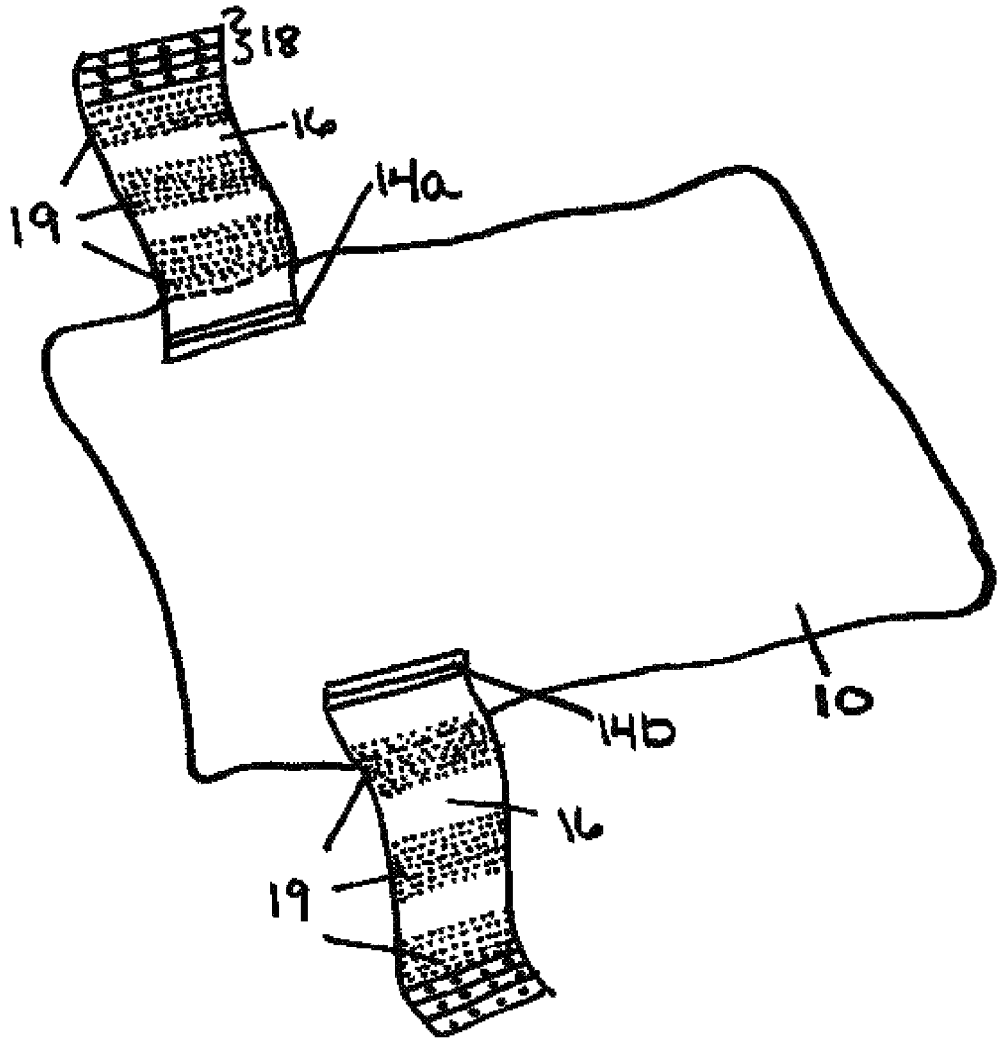
FIG. 1 is a prospective view of the under side of the preferred embodiment.

FIG. 1 is a top prospective view of the preferred embodiment. The cover piece 10 is shown with its top side facing down and the member 16 shown with adjustable means 18 disconnected. The member 16 is flexible and stretchable. In an embodiment, the member comprises a no-slip element 19, having a rubber, gripping, bumpy-like texture, which may be integral to the member 16 or an added feature, added to the member at intervals along each a top and bottom side of the member. FIG. 1 shows member 16 with no-slip element 19 in sections, however member 16 may be produced without no-slip element 19 or with various patterns or other intervals. In an embodiment, the member 16 is permanently attached to the cover piece 10 by attachment means 14*a*, 14*b*. The member is attached by well-known permanent attachment means, such as but not limited to, stitching, adhesive, grommets, heat bonding, and the like. In an alternate embodiment, the member 16 is manufactured as detachable, with hook and pile fasteners, snaps, or any other connection means.

The adjustable means 18 allows the member 16 to be adjusted to the desired length. The adjustable means 18 is shown in FIG. 1 at the center, however, the adjustable means 18 may be located at any point along the member, such as but not limited to adjacent to the side of the mattress so that the user may adjust the member without moving the mattress.

Figure 2:
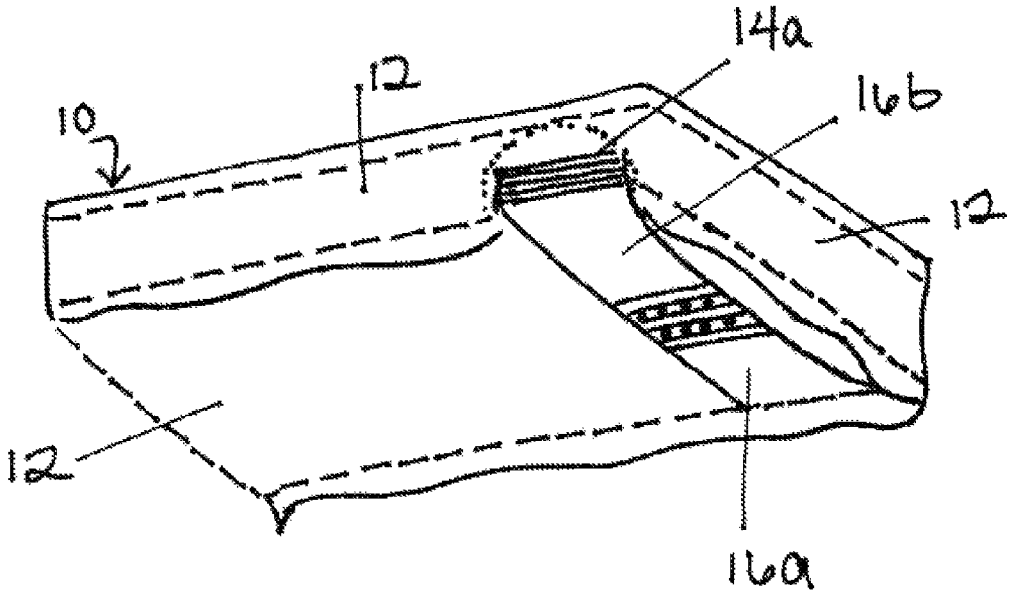
FIG. 2 is a prospective, cross-sectional, bottom view of the preferred embodiment secured to a mattress.

FIG. 2 shows a bottom cross-sectional, prospective view of the bed covering with the cover piece 10 in place and secured to a mattress without a bed frame or box spring. In an embodiment, the member 16 has a no-slip gripping texture 19. The member intersects or attaches to the cover piece 10 at a point of the cover piece 10 near both foot corners of the mattress 12 when the bed covering is on a bed. The area of attachment 14 *a, b* is approximately 5-15 inches wide. The area of attachment 14 *a, b* where the cover piece 10 and the member are joined is about 2-5 inches deep across the width of the member.

The method for placing the present invention in place involves first adjusting the adjustable means so that the member 16 is the desired length. Then, the cover piece 10 and member 16 are placed on top of the mattress 12. A first side 16*a* of the member 16 is stretched around a corner of the foot of the mattress 12, placing the member partially in position. Next, the remaining and opposite side of the member 16*b* is stretched around the remaining and opposite corner of the foot of the mattress 12, while the first side remains in place. The member 16 is out of sight under the cover piece 10 when in place.

Figure 3:
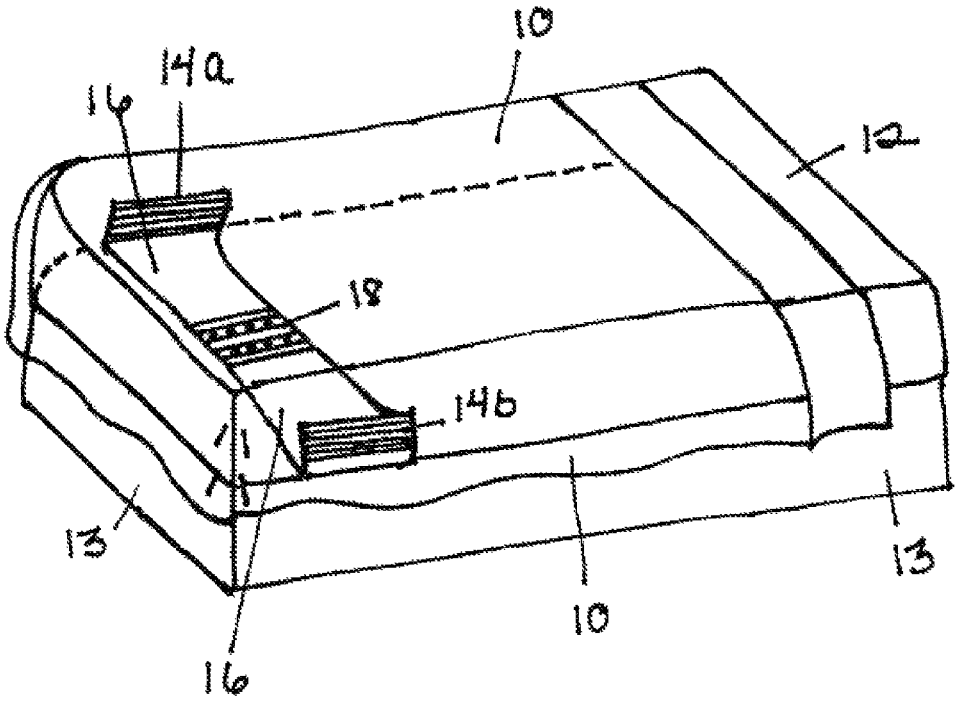
FIG. 3 is a prospective top view of the preferred embodiment secured to a mattress. The mattress is on top of a box spring or bed frame.

FIG. 3 is a top, cross sectional, partial prospective view of the cover piece 10 secured to a mattress 12. The member 16 is positioned underneath the mattress 12 and on top of box spring or bed frame 13.

Figure 4:
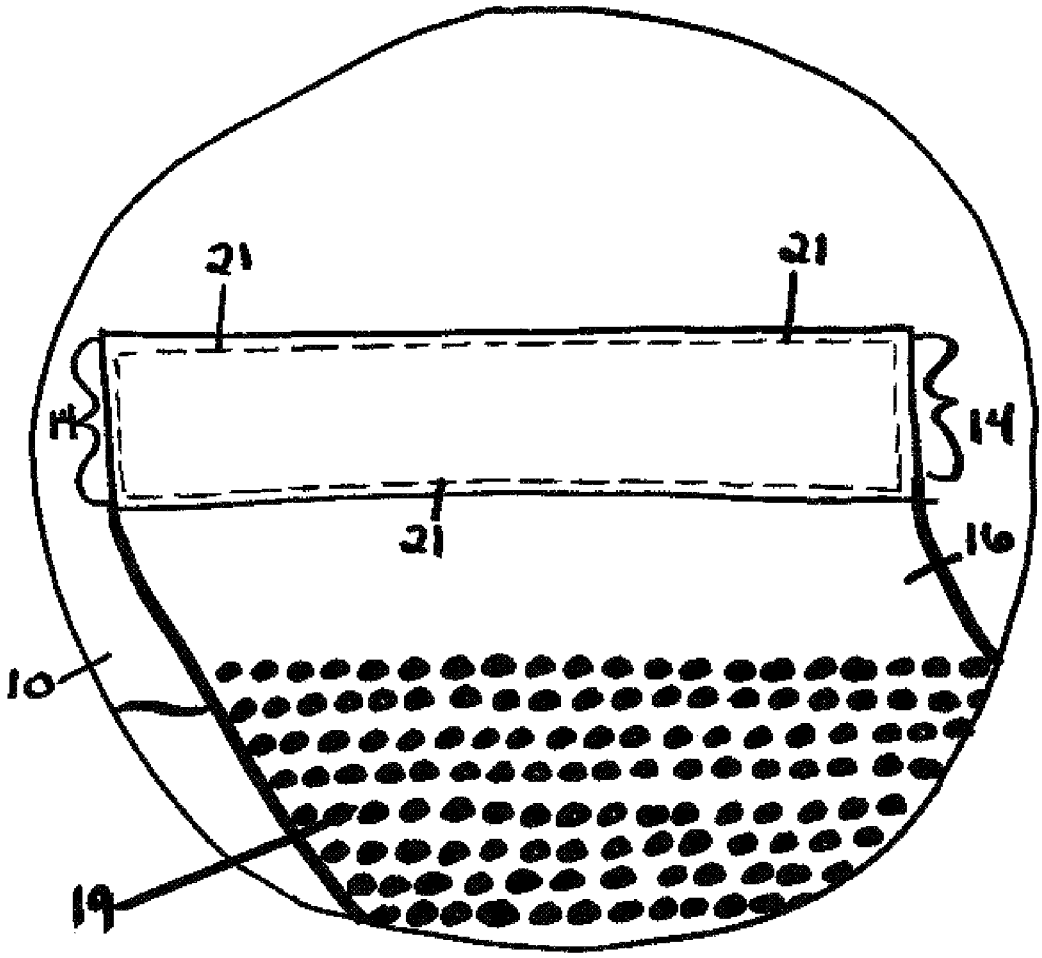
FIG. 4 is a close-up view of the bed covering where it intersects the member.

FIG. 4 is a close-up view of the under-side of the cover piece 10 with the member 16 shown as permanently attached at the area of attachment 14 *a*, 14 *b*. The area of attachment 14 is shown sewn on to cover piece 10 at stitching area 21. Stitching area 21 represents one means of attaching member 16 to cover piece 10. The member 16 may be attached at area of attachment 14 with other permanent means, such as but not limited to, stitching, adhesive, grommets, heat bonding, and the like. In an alternate embodiment, the member 16 is manufactured as detachable at area of attachment 14, with hook and pile fasteners, snaps, or any other connection means. Member 16 is shown with intervals of a gripping surface 19 in sections in FIG. 4. The gripping surface 19 may be present in sections as shown in FIG. 4, absent, or over the entire surface without sections.

While the forms of the invention herein disclosed constitute presently preferred embodiments, many others are possible. It is not intended herein to mention all of the possible equivalent forms or ramifications of the invention. It is to be understood that the terms used herein are merely descriptive, rather than limiting, and that various changes may be made without departing from the spirit of the scope of the invention.

I claim:

1. An improved bed covering comprising:

(a) a generally rectangular cover piece comprising (i) a first end and a second end, said second end opposite the first end, (ii) a first side and a second side, said second side opposite the first side, (iii) a top side and a bottom side, said top side opposite the bottom side and connected to the bottom side at the first and second end and the first and second side; and (b) an elastic member; said member having a width of at least about 6 inches; said member having only two parts, a first end of each part permanently attached to the first end of the bottom side of the cover piece, each at either side of the cover, each first end attached to the cover by stitching an about 2-5 inches section of a length of the first end, said stitching extending the entire width of the member, said opposite end of each part having a hook and pile fastener such that when the two parts are attached to each other at second ends of each, the member is of sufficient length to extend under a mattress and is not visible while the cover is positioned on a bed.

2. The improved bed covering of claim 1 wherein the member is a fabric having a laid-in structure of at least longitudinally extending elastene strands or filaments.

3. The improved bed covering of claim 1 wherein the member is comprised of layers with an elastic central layer covered with a flexible fabric covering.

4. The improved bed covering of claim 1 wherein the member is comprised of at least one layer comprising a material selected from the group consisting of a rubber and an elastene.

5. The improved bed covering of claim 1 wherein the cover piece is one of a comforter, a blanket, a quilt and a duvet cover.

6. The improved bed covering of claim 1 wherein the mattress is on top of another surface.

7. The improved bed covering of claim 6 wherein the surface is one of a box spring, a floor, a mattress support and a bed frame.

8. The improved bed covering of claim 1 wherein the cover piece is placed over other bedding.

* * * * *